United States Patent [19]

Goldhammer

[11] Patent Number: 4,619,407

[45] Date of Patent: Oct. 28, 1986

[54] SHREDDING MACHINE AND METHOD OF OPERATION

[75] Inventor: Albert Goldhammer, Überlingen, Fed. Rep. of Germany

[73] Assignee: Firma Feinwerktechnik Schleicher & Co., Markdoff, Fed. Rep. of Germany

[21] Appl. No.: 683,588

[22] Filed: Dec. 19, 1984

Related U.S. Application Data

[63] Continuation of Ser. No. 362,468, Mar. 26, 1982, abandoned.

[30] Foreign Application Priority Data

Mar. 31, 1981 [DE] Fed. Rep. of Germany ..... 3112913

[51] Int. Cl.[4] ..... B02C 18/40

[52] U.S. Cl. ..... 241/30; 83/76; 241/36; 241/236

[58] Field of Search ..... 241/30, 32, 35, 36, 241/222–225, 235, 236; 83/76, 72; 318/432, 775

[56] References Cited

U.S. PATENT DOCUMENTS 3,880,361 4/1975 Schwarz ..... 241/36

4,026,480 5/1977 Meyers ..... 241/30

*Primary Examiner*—Howard N. Goldberg

*Assistant Examiner*—Timothy V. Eley

*Attorney, Agent, or Firm*—Lackenbach Siegel Marzullo Presta & Aronson

[57] ABSTRACT

The invention relates to a method for operating a shredding machine with high power for the comminution of multilayered paper, data carriers and the like with at least one drive motor and a stator winding, which upon overloading of the shredding machine automatically is switched to reverse. The operation of the machine is possible without fear of overloading the machine and the user has no need to nor temptation to grip with one's hand paper jammed into the shredding machine. The object of the invention is achieved by providing a second stator winding, which upon overloading of the shredding machine is initially connected in parallel to the one stator winding. Therefor, in case of overloading no switching into reverse occurs, but for a limited time of, for example, 10 seconds a second stator winding is connected in parallel to the first stator winding.

7 Claims, 9 Drawing Figures

FIG. 2
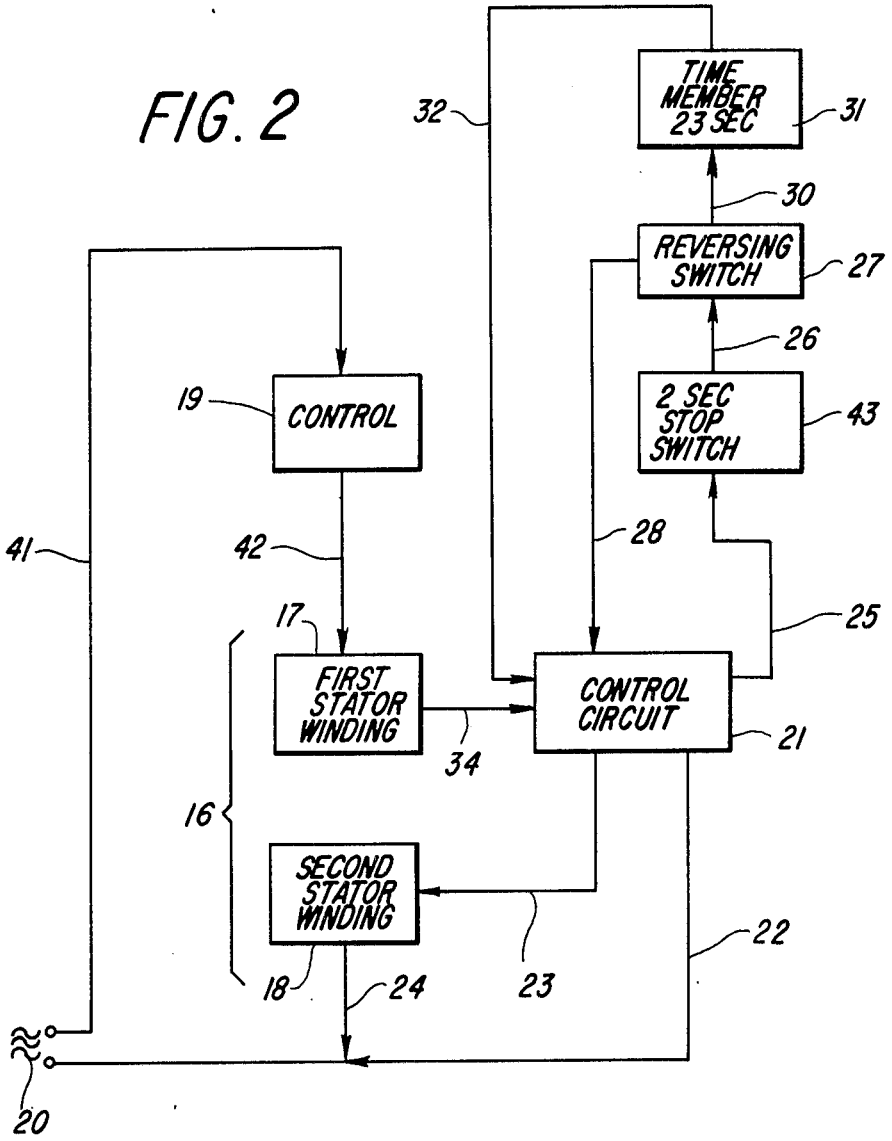
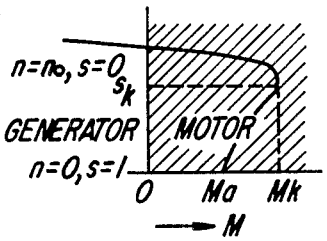
FIG. 3

OVERLOAD OPERATION

REGULAR OPERATION

SHREDDING MACHINE AND METHOD OF OPERATION

This is a continuation of application Ser. No. 362,468, now abandoned filed Mar. 26, 1982.

The invention relates to a method for operating a shredding machine and to a shredding machine operated accordingly with high throughput for comminution of multilayer papers, data carriers and the like with at least one drive motor and a stator winding, which works via at least one drive train on cutter blocks of the shredding machine and which can be switched over into reverse run automatically upon an overloading of the shredding machine.

With heavy shredding machines the problem arises that according to experience such shredding machines are always overloaded. Heavy shredding machines can be defined for example as such machines, which can shred a paper stack of the size German Industrial Standard DIN-A-4 of 3.5 centimeter thickness with about 350 sheets in one run. For example, in this case a cutting width of 8 centimeters is achieved with the shredded paper strips at the discharge end of the shredding machine with a work width of from 450 to 500 millimeters of the shredding machine.

Such shredding machines are also in a position to comminute without difficulty the metal parts of file folders. According to experience such heavy shredding machines are always overloaded by the user entering too much material at the feed end of the shredding machine and the drive motor cannot any longer handle with its torque the material passing between the cutter blocks, such that the shredder stalls. Based on the then flowing short circuit current, overheating of the drive motor results and the stator winding burns through. Similarly, there is a danger for the drive train, the other drive elements and the cutting elements such that in any case such an overloading should be avoided so that the machine retains its designed, long life time.

Conventionally known shredding machines switch automatically to reverse operation in case of an overload, that is the drive motor is automatically switched to reverse run upon reaching of a certain stator current such that the previously between cutter blocks pulled in material is transported back again to the feed end. After a precisely fixed time, for example 2 seconds, the drive motor is again switched to forward such that the material is pulled in again.

The starting point in this context is that the material rearranges during the reverse run of the drive motor and pulls apart, such that upon a renewed pulling in of the material into the shredding machine a better comminution is achieved and a short circuiting of the drive motor does not occur.

However, it is a disadvantage of these known devices that in the case of overloading such machines are switched ten or twenty times from forward into reverse and nevertheless no sufficient comminution of the pulled in material is achieved. Finally, the user has to switch off the complete machine and has to use one's hands to unjam the shredding machine in order to remove any stoppages. Besides this cumbersome and labor intensive handling such method in addition is also extremely dangerous, since the danger exists that the shredding machine in this state is turned on by mistake and the user brings his hands into the shredding machine. In addition, there is the danger of injuries by pointed metal parts, which are still in the shredding machine, and which had been comminuted.

It is the object of the present invention to improve an method for operating a shredding machine and a shredding machine accordingly operated such that upon retaining of the high comminution power a certain destruction and comminution of the fed in material is possible without the fear of overloading the shredding machine and without the need for the user to grip jammed material in the shredding machine by hand.

The shredding machine of the invention may be safely operated while maintaining a high power of comminution.

The object is achieved by an operating method characterized in that upon overloading of the shredding machine initially a second stator winding is connected in parallel to the one stator winding.

A completely new way is employed in the disclosed operational method, since in the case of overloading now it is not any longer immediately switched to reverse operation, but initially for a limited time of for example 10 seconds a second stator winding is connected in parallel to the first stator winding.

Thereby the stator drive torque of the drive motor is substantially increased (for example by an amount of 40 percent). Thereby a continuous oscillating operation between forward and reverse run is avoided, and the comminution power is further substantially improved, since in the case of overloading for a short time a second stator winding is additionally connected (or more general: a second drive winding) such that the material disposed in the shredding machine is pulled in with increased torque and is destroyed.

In order to avoid a thermal overloading of the drive motor the additional switch on of the second stator winding is provided only for a limited time of for example 10 seconds. This time depends on the thermal situation of the drive motor, that is from its cooling and from the setting of a thermal overload fuse.

Only after termination of the additional switch on time of the second winding the direction of rotation of the drive motor is reversed for a limited time of for example 25 seconds.

In the method at the feed end of the shredding machine a transport band is preferably provided onto which the material to be shredded is loaded. This feed-in transport band is reversible in a direction of rotation together with the direction of rotation of the drive motor, such that upon reversal of direction of rotation of the drive motor the material disposed at the feed end is again transported backward to the input place with the reversal of the direction of rotation of the feed-in transport band, in order to be repositioned and reordered. Again, a new orienting of the material on the feed transport band occurs upon a renewed reversal of direction of rotation of the feed-in transport band and of the drive motor in the sense of a forward run or of regular operation, whereby the comminution power is still substantially improved.

The connection of a second drive winding, which is connected in parallel to the first winding, is possible for several motor types. Both simple alternating current squirrel cage rotors are possible, which are running from a two phase current, as well as heavy three phase rotary current motors.

In the last mentioned embodiment it is preferred if a rotary current asynchronous motor is employed as a three phase rotary current motor, where the stator winding is connected as a triangle under regular operation and the rotor winding of which is provided as a squirrel cage rotor (short circuited rotor).

However, similarly also rotary current motors with brushes are to be considered and are comprised by the present invention.

Upon employment of a rotary current asynchronous motor connected under regular operation in a triangle, it is preferred for the added connection of a second winding, if in the case of overloading the stator winding connected as a triangle can be switched over to two parallel connected star windings.

Thus there results a drive power increased by up to 40 percent; that is at a motor, with an electrical drive power of 4 kilowatts in the overload case, an electrical drive power of 5.5 kilowatts is obtained. According to the subject matter of the present invention the drive power is increased by 40 percent by elimination of a threatened stoppage of the shredder by switching over the triangular stator winding into a double star stator winding; but it is even more essential that the pull out torque is increased also by about 40 percent. Such rotary current asynchronous motors are operated near the pull out torque in order to have available the highest possible torque. The pull out torque is a certain critical limit and the highest achievable torque. If the motor is loaded beyond it pull out torque, then the motor stalls.

According to the present invention, the region of the torque is increased by about 40 percent, which results between the starting torque and the pull out torque.

In the drawings:

FIG. 2 is a block circuit diagram of the control for the drive motor;

Figure 6:
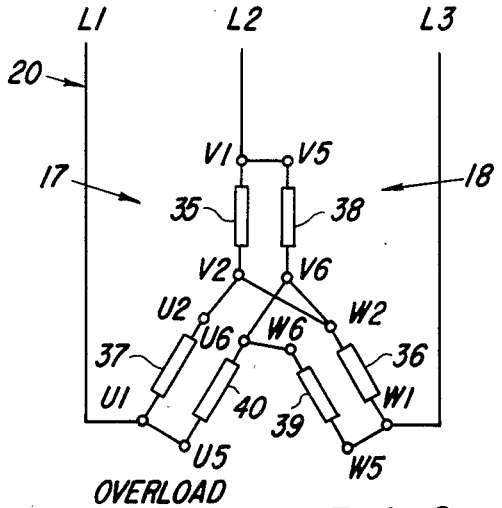
Figure 7:
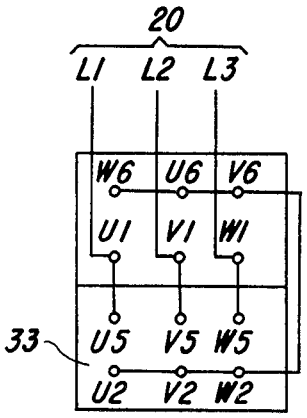
Figure 4:
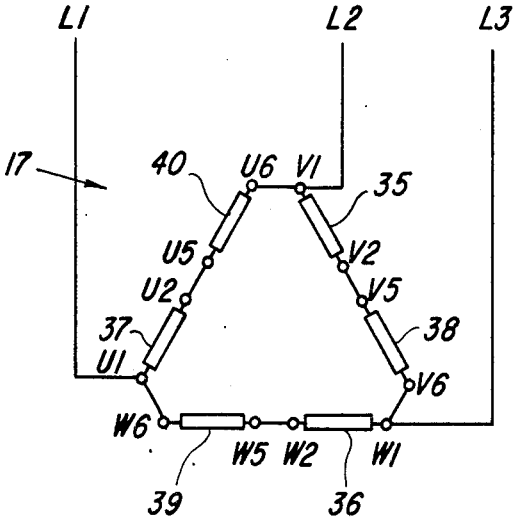
Figure 5:
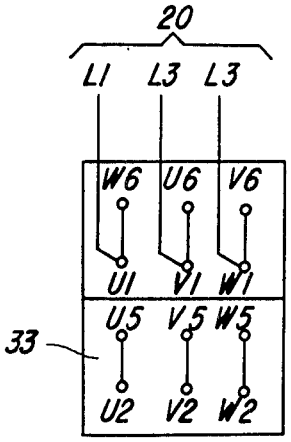
Figure 8:
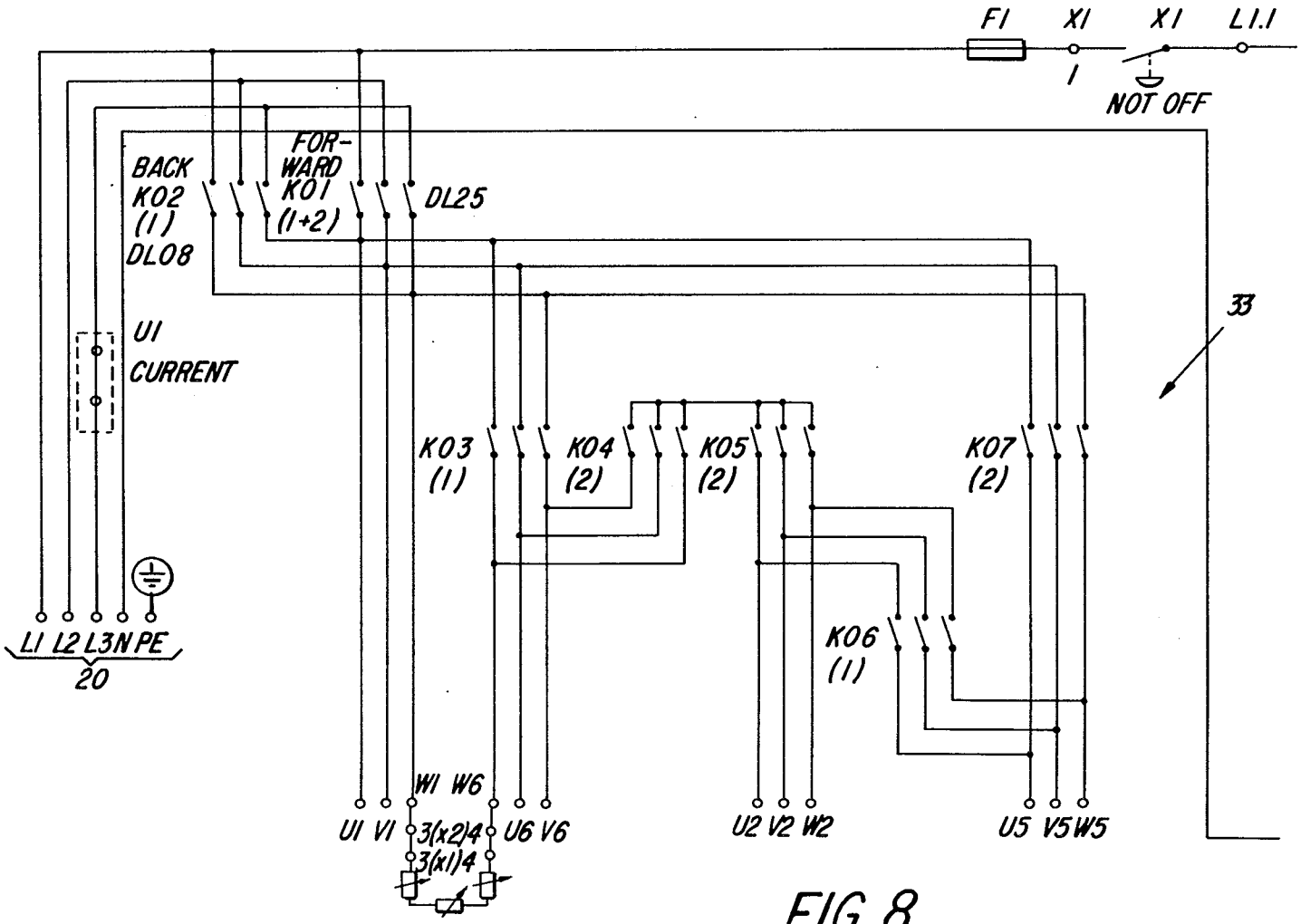
Figure 9:
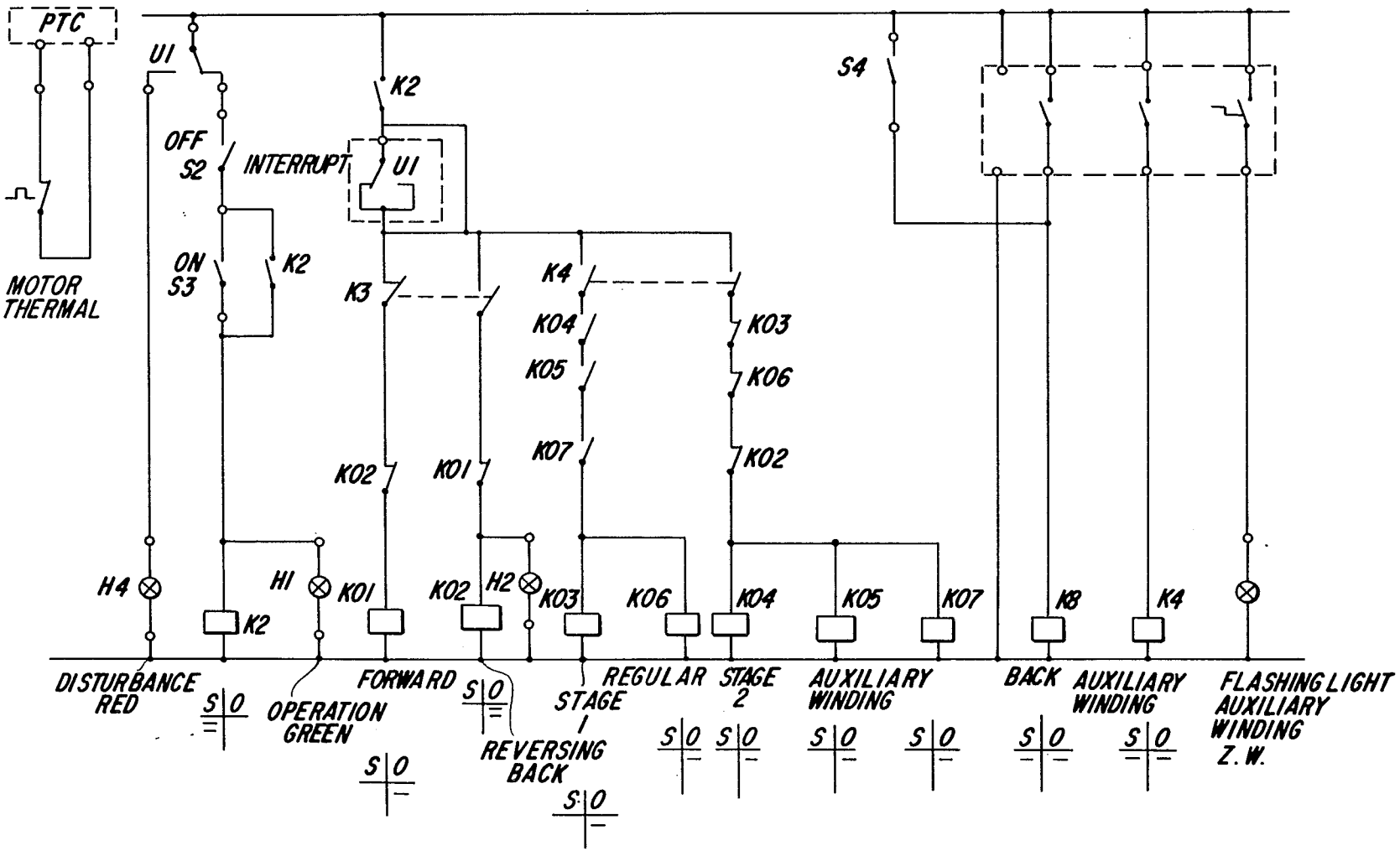

FIG. 3 a rotation speed-torque-characteristic curve of a rotary current asynchronous motor;

FIG. 4 a circuit of the stator winding in regular operation;

FIG. 5 a schematic representation of the terminal board employed for this purpose with the switches belonging thereto;

FIG. 6 a circuit of the stator winding in the overload operation;

FIG. 7 a circuit at the terminal board for this purpose;

FIG. 8 a schematic view of the current distribution plan for the switch for changing over from a triangular operation to double star operation; and FIG. 9 a schematic view of a drawn current distribution picture of the electric circuit of the shredding machine.

Figure 1:
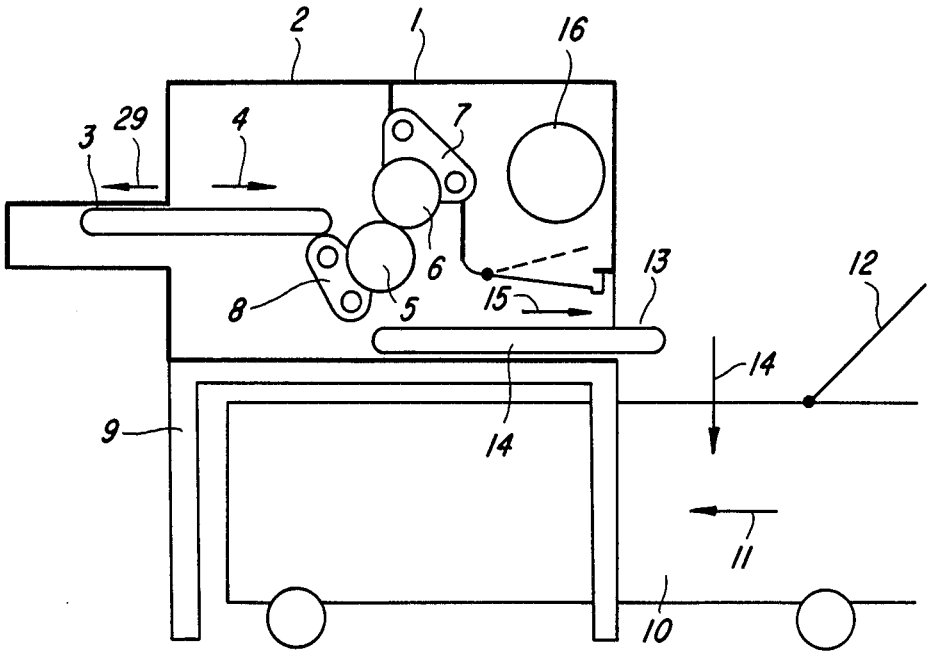
FIG. 1 is a schematic side view of the representaion of a shredding machine made according to the invention.

The shredding machine 1 shown in FIG. 1 comprises a feed transport band 3 disposed in a case 2, which feed transport band feeds the material in the direction of the arrow 4 to the shredding machine, which comprises two cutter blocks 5 and 6. Wiper fingers 7, 8 prevent the bringing back of material in an unallowed way from the discharge end to the feed end of these cutter blocks 5, 6.

The shredding machine is disposed on a table frame 9 and is moved over a vertical operating baling press 10 or respectively the baling press is moved in the direction 11 under the table frame, where the material coming out at the discharge end 13 of the shredding machine 1 falls via the opened feed plate 12 of the baling press in the direction of arrow 14 into the work area of the baling press.

A discharge transport band 14 is disposed at the discharge end 13 of the shredding machine 1, which transports the material comminuted to strips out in the direction of arrow 15. The discharge transport band is provided in the direction opposite to the shown arrow direction 14 with a free-wheel drive, such that the direction of rotation of this discharge transport band 14 is not reversible.

All drive elements, that is the feed transport band 3, the discharge transport band 14 and the cutter blocks 5, 6 are driven synchronously by the drive motor 16 via a drive train, for example a V-belt.

According to a further embodiment not shown in detail here it could also be provided that the feed transport band 3 runs with a lower feed speed as compared with the cutter blocks and the discharge transport band 14.

FIG. 2 shows in a schematic way the electrical control, which connects a second stator winding 18 in parallel to the first stator winding 17 in case of overloading.

The winding 17, which is connected in the regular operating condition, is connected via the line 41, the control 19, the line 42, the line 34, the control circuit 21, the line 22 at the three phase power supply 20. Initialy the stator winding 17 is connected via the control 19, whereby the control circuit 21 becomes effective, which is in the regular operating sitation connected to the three phase power supply 20 via line 22.

An increased current flowing through the winding 17 and determined by the control circuit 21 actuates the control circuit 21 in the overloading case. The control circuit 21 then switches over from line 22 to line 23, by way of which the second stator winding is conected in parallel to the first stator winding. The second stator winding 18 is conected to the three phase power supply 20 via the line 24. Thereby as described above the drive torque and in particular in case of the use of a three phase motor the pull out torque are increased by about 40 percent.

In case by way of also switching on the second stator winding 18 the plugging or disturbance in the shredding machine could not be avoided, than after about 10 seconds a stop switch 43 is connected via line 25 from the control circuit, which stops for about 2 seconds the complete electrical drive. The start-stop switch 43 in turn controls a reversing switch 27 via line 26, which acts via line 28 on the control circuit 21. Then the direction of rotation of the drive motor is reversed, where only the stator winding 17 remains switched on.

At the same time a time member 31 is activated with the reversing switch 27 via the line 30, which time member allows the reversing switch 27 to become active via line 32 and the control circuit 21 for about 23 seconds. After running out of this time member, that is after the passage of 23 seconds, the complete drive goes back to regular operation, that is the control circuit 21 switches the drive motor 16 to forward operation, where only the stator winding 17 is connected to the three phase power supply 20 via the lines 41, 42, 34, 22.

It is essential with the described electrical processes that also the feed transport band 3 runs backward in the direction of the arrow 29 with the reversal of the rotation direction of the drive motor 16, whereby the material is brought back to the feed position and is reoriented there.

FIG. 3 shows schematically the rotation speed-torque-characteristic curve of a three phase asynchronous motor, as it is preferably employed according to the present invention.

From the mentioned rotation speed-characteristic curve according to FIG. 3 it can be gathered that at a pull out torque slippage $s_k$ the pull out torque $M_k$ is reached. If the motor is loaded beyond its pull out torque, then the motor stalls.

According to the present embodiment the motor is always operated on the branch of the characteristic curve between the starting torque $M_a$ and the pull out torque $M_k$. A rotation speed characteristic curve is shown as it could be achieved alone with the stator winding 17.

FIG. 4 shows the wiring of the stator field according to a preferred embodiment of a three phase asynchronous motor. The stator winding 17 connected as a triangle comprises in this case several in series connected individual windings, where at each side of the triangle two individual windings are connected in series. The windings concerned here are the individual windings 35, 38; 36, 39; and 37, 40; the connection points V1, V2, V5, V6, W1, W2, W5, W6, U1, U2, U5, U6 are shown in their proper position.

FIG. 5 shows the wiring at the terminal board with a schematic representation of a switch 33 and of the connections required for this.

FIG. 6 shows the switching of the stator winding 17 into a double star circuit with parallel connection of a second stator winding 18. It is important in this context that the previously in series triangle connected individual windings are now connected as double star windings, whereby the required increased torque is achieved. The first stator winding 17 connected as a star comprises the individual windings 35, 36, 37 whereas the second stator winding 18 connected thereto in parallel comprises the individual windings 38, 39, 40.

FIG. 7 shows the changed course of the current at the switch 33 upon changeover switching of the windings according to FIG. 6.

FIG. 8 shows such a switch with which the switching from a triangular operation to a double star operation is possible. The switching symbols of the switches K01 to K07 repeat in the current course plan shown in FIG. 9 of the total electrical control of the shredding machine according to the invention.

A motor contactor control circuit is shown on the upper left, which operates with a (positive temperature coefficient) PTC-resistor.

The regular operation is turned on via the switch S3; K2, which is indicated via the indicator lamp H1 in green.

The interruption for a preselected duration is switched on via the switch K2, while by way of the switch symbols disposed below the corresponding coils it is shown by way of which current lines the switches K01 to K07 are controlled, which switches are provided as relays.

I claim:

1. Operation method for running a shredding machine of high throughput for comminution of multilayer papers, data carriers or the like with at least one drive motor (16) and a stator winding (17), which operates via at least one drive train on the cutter blocks (5,6) of the shredding machine and which upon overloading of the shredding machine can be automatically switched over to reverse operation, characterized in that upon overloading of the shredding machine initially a second stator winding (18) is connected in parallel to the one stator winding (17).

2. A method for running a shredding machine of high output for the comminution of multi-layered papers, data carriers or the like with at least one drive motor having a plurality of windings, and operating via at least one drive train on means comprising a plurality of rotary cutter elements, characterized in that during forward operation of said drive motor a switching means responsive to an overloading condition thereof occurring upon overloading of the shredding machine switches and connects at least one of said windings in parallel with a second of said windings for a first predetermined time period so as to increase the output torque of said drive motor; reversing the operation of said drive motor for a second predetermined time period upon the overloading condition being maintained for said first predetermined time period, and switching said drive motor back to forward operation after said second predetermined time period; whereby the shredding machine is enabled to operate under an overloading condition without danger of overheating the drive motor.

3. The method according to claim 2, characterized in that the first time period during which the second winding remains switched in parallel with the first winding is about 10 seconds.

4. The method according to claim 2 or 3, characterized in that the second time period during which the direction of the drive motor is reversed is about 25 seconds.

5. A shredding machine of high power comprising at least one drive motor having a plurality of stator windings which are connected in series during regular operation of the drive motor;

switching means connected to the stator windings and responsive to the current therein to reconnect the stator windings in parallel to thereby increase the torque of the drive motor for a first predetermined time interval upon occurrence of an overload operating condition of the drive motor and to reconnect the stator windings in series at the end of such first time interval; and further switching means connected to the stator windings and responsive to the current therein to reverse the connection of the windings and thereby reverse the direction of rotation of the drive motor for a second predetermined time interval upon continued overload operation of the drive motor after said first predetermined time interval.

6. A shredding machine according to claim 5, wherein the drive motor is a three phase asynchronous motor and the stator windings comprise pairs of windings which are connected in series along each side of a triangle under regular operating conditions and which are connected in parallel along each side of a star under overload operating conditions.

7. A shredding machine according to claim 6, wherein the drive motor has a squirrel cage rotor and the electrical drive power of the motor is increased about forty percent when the stator windings are reconnected from series triangular configuration to parallel star configuration upon occurrence of an overload operating condition of the motor.

* * * * *